US010687616B2

(12) United States Patent
Brennan

(10) Patent No.: US 10,687,616 B2
(45) Date of Patent: Jun. 23, 2020

(54) TABLE TOP FENCE RAIL SYSTEM

(71) Applicant: Darren T. Brennan, Massapequa, NY (US)

(72) Inventor: Darren T. Brennan, Massapequa, NY (US)

( * ) Notice: Subject to any disclaimer, the term of this patent is extended or adjusted under 35 U.S.C. 154(b) by 0 days.

(21) Appl. No.: 16/290,298

(22) Filed: Mar. 1, 2019

(65) Prior Publication Data

US 2020/0069047 A1 Mar. 5, 2020

Related U.S. Application Data

(60) Provisional application No. 62/769,535, filed on Nov. 19, 2018, provisional application No. 62/726,339, filed on Sep. 3, 2018.

(51) Int. Cl.

| | |
|---|---|
| ***A47B 37/04*** | (2006.01) |
| ***A47B 13/00*** | (2006.01) |
| ***E04H 17/14*** | (2006.01) |
| ***E04H 17/00*** | (2006.01) |

(52) U.S. Cl.

CPC ..... *A47B 37/04* (2013.01); *A47B 13/003* (2013.01); *E04H 17/1417* (2013.01); *A47B 2013/006* (2013.01); *E04H 2017/006* (2013.01)

(58) Field of Classification Search

CPC . A47B 37/04; A47B 13/003; A47B 2013/006; A47B 2220/0008; E04H 17/1417; E04H 2017/006; A45B 2200/1063

See application file for complete search history.

(56) References Cited

U.S. PATENT DOCUMENTS

| | | | | |
|---|---|---|---|---|
| 2,743,146 | A * | 4/1956 | Wheeler | A45B 23/00 108/50.12 |
| 2,799,543 | A * | 7/1957 | Tomaselli | A45B 23/00 108/50.12 |
| 3,620,174 | A * | 11/1971 | Dentino | A47B 13/08 108/151 |
| 3,683,824 | A * | 8/1972 | Weber | A47B 9/00 108/92 |
| 3,706,105 | A | 12/1972 | Nicholas et al. | |
| 4,059,248 | A | 11/1977 | Kuntz | |
| 4,353,659 | A * | 10/1982 | Comte | A47B 37/04 108/50.12 |
| 4,570,803 | A | 2/1986 | Peterson | |
| 4,722,514 | A * | 2/1988 | Pettit | E04H 17/1421 256/19 |
| 4,889,057 | A | 12/1989 | Chartrand | |

(Continued)

FOREIGN PATENT DOCUMENTS

| | | | |
|---|---|---|---|
| CA | 2132079 | A1 | 3/1996 |
| CN | 101176593 | A | 5/2008 |

*Primary Examiner* — Hanh V Tran

(74) *Attorney, Agent, or Firm* — Carter, DeLuca & Farrell LLP

(57) ABSTRACT

A table top fence rail system includes a fence, a table top including a body having planar top and bottom surfaces. The body defines an opening that extends between the top and bottom planar surfaces and is dimensioned to receive the upper end portion of a respective post of the fence. A cap is supported on the upper end portion of the post and is dimensioned to retain the planar bottom surface of the body of the table top on the upper support surface of the upper horizontal rail of the fence.

17 Claims, 9 Drawing Sheets

(56) References Cited

U.S. PATENT DOCUMENTS 5,240,214 A 8/1993 Birnbaum et al.
5,472,164 A 12/1995 Contee, Jr.
5,653,178 A 8/1997 Huczka
5,996,511 A * 12/1999 Swoger ..... A47B 57/26 108/151
6,474,244 B1 11/2002 Karpinski
6,931,998 B1 8/2005 Leese
7,121,213 B2 10/2006 Viazanko et al.
8,336,837 B2 12/2012 Gephart et al.
8,397,648 B1 * 3/2013 Palladino ..... A47B 37/04 108/42
8,915,197 B2 12/2014 Raml
8,979,045 B2 3/2015 Petrakis
9,814,305 B2 11/2017 Brus et al.
10,098,450 B1 10/2018 Brewer et al.
2005/0034638 A1 * 2/2005 Li ..... A47B 11/00 108/50.12
2005/0109247 A1 * 5/2005 Nelson ..... A47B 37/04 108/42
2005/0210773 A1 * 9/2005 Steffes ..... E04H 17/20 52/169.9
2005/0210786 A1 * 9/2005 Hales ..... E04H 17/20 52/301
2005/0241546 A1 * 11/2005 Royse ..... A47B 37/04 108/44
2006/0180058 A1 8/2006 Monson
2007/0034758 A1 2/2007 Bates
2007/0101908 A1 5/2007 Makita
2007/0265144 A1 11/2007 Jackson et al.
2009/0000523 A1 1/2009 Ciardelli
2009/0020047 A1 1/2009 Noble et al.
2009/0200841 A1 8/2009 Rhoten
2013/0264440 A1 * 10/2013 Auracher ..... A45F 3/46 248/149
2014/0061561 A1 * 3/2014 Brit ..... E04F 11/181 256/1
2014/0345499 A1 11/2014 Wilson
2015/0090162 A1 4/2015 Vlosich
2015/0108123 A1 4/2015 Linehan et al.
2015/0136923 A1 * 5/2015 Berio ..... A01G 9/02 248/219.2
2015/0240515 A1 * 8/2015 Davis ..... E04H 17/20 256/1
2016/0120301 A1 5/2016 Cross et al.
2016/0143469 A1 * 5/2016 Higgins ..... A47G 23/0208 220/737
2016/0325197 A1 11/2016 Smith
2016/0353877 A1 12/2016 Brus et al.
2017/0150837 A1 6/2017 Flannery et al.
2017/0311712 A1 11/2017 Walker
2017/0332794 A1 11/2017 Melaragno

* cited by examiner

TABLE TOP FENCE RAIL SYSTEM

CROSS-REFERENCE TO RELATED APPLICATIONS

This application claims the benefit of and priority to U.S. Provisional Patent Application Ser. No. 62/769,535, filed Nov. 19, 2018, and U.S. Provisional patent Application Ser. No. 62/726,339, filed Sep. 3, 2018. The entire contents of each of the above disclosures are hereby incorporated by reference.

BACKGROUND

1. Technical Description

The present disclosure is directed to a system for incorporating a table top onto an existing fence and, more particularly, to a system for incorporating a table top onto an existing vinyl fence.

2. Background of Related Art

Vinyl fences for enclosing a specified area are well known. These fences are typically used to enclose yards, pools, boat docks, or the like to keep animals or children from entering or exiting the area. In such areas where socializing may be common, it is known to have tables separate from the existing fence to provide support for drinks, food, radios, or the like.

A continuing need exists in the art for an aesthetically pleasing table top that can make use of existing support structure of the fence and provide a more efficient use of existing space.

SUMMARY

One aspect of the disclosure is directed to a table top fence rail system that includes a fence, a table top, and a cap. The fence includes first and second posts, an upper horizontal rail extending between the first and second posts, a lower horizontal rail extending between the first and second posts, and a plurality of slats positioned between the posts. The upper horizontal rail defines an upper support surface, and the first and second posts have an upper end portion and a lower end portion. The table top includes a body having planar top and bottom surfaces. The body defines an opening that extends between the top and bottom planar surfaces and is dimensioned to receive the upper end portion of a respective one of the first and second posts. The cap is supported on the upper end portion of the respective one of the first and second posts and is dimensioned to retain the planar bottom surface of the body of the table top on the upper support surface of the upper horizontal rail of the fence.

In embodiments, the opening defined by the body of the table top and the respective one of the first and second posts are rectangular.

In some embodiments, the opening defined by the body of the table top is centrally positioned within the body of the table top.

In certain embodiments, the opening defined by the body of the table top is positioned along one side of the body of the table top.

In embodiments, the body of the table top has a rectangular configuration.

In some embodiments, the body of the table top has a circular configuration.

In certain embodiments, a sleeve positioned about the upper end portion of the respective one of the posts between the upper planar surface of the body of the table top and cap.

In embodiments, at least one of the sleeve and the cap is secured to the upper end portion of the respective one of the posts.

In some embodiments, the opening defined by the body of the table top is larger than the respective one of the posts, and the sleeve includes a lower extension that is received between the upper end portion of the respective one of the posts and the body of the table top to snugly position the table top on the upper end portion of the respective one of the posts.

In certain embodiments, the slats extend vertically between the upper and lower horizontal rails of the fence.

Another aspect of the disclosure is directed to a table top fence rail system that includes a fence, a table top, and a securing mechanism. The fence includes first and second posts, an upper horizontal rail extending between the first and second posts, a lower horizontal rail extending between the first and second posts, and a plurality of slats positioned between the posts. The upper horizontal rail defines an upper support surface, and the first and second posts have an upper end portion and a lower end portion. The table top includes a body having planar top and bottom surfaces and a bracket supported on the planar bottom surface of the body of the table top. The bracket has a U-shaped body that defines a U-shaped channel that is dimensioned to receive the upper horizontal rail of the fence. The securing mechanism is positioned beneath the upper horizontal rail to secure the table top to the upper horizontal rail.

In embodiments, the U-shaped body of the bracket includes first and second ends that extend beneath the upper horizontal rail when the table top is positioned on the upper support surface of the upper horizontal rail of the fence.

In some embodiments, the securing mechanism includes a bolt and a wing nut.

In certain embodiments, the securing mechanism includes hook and loop fasteners.

In embodiments, the securing mechanism includes a C-shaped body and the securing mechanism includes a threaded clamp.

Other features of the disclosure will be appreciated from the following description.

BRIEF DESCRIPTION OF THE DRAWINGS

Various embodiments of the presently disclosed kit are described herein below with reference to the drawings, wherein.

DETAILED DESCRIPTION OF EMBODIMENTS

Figure 1:
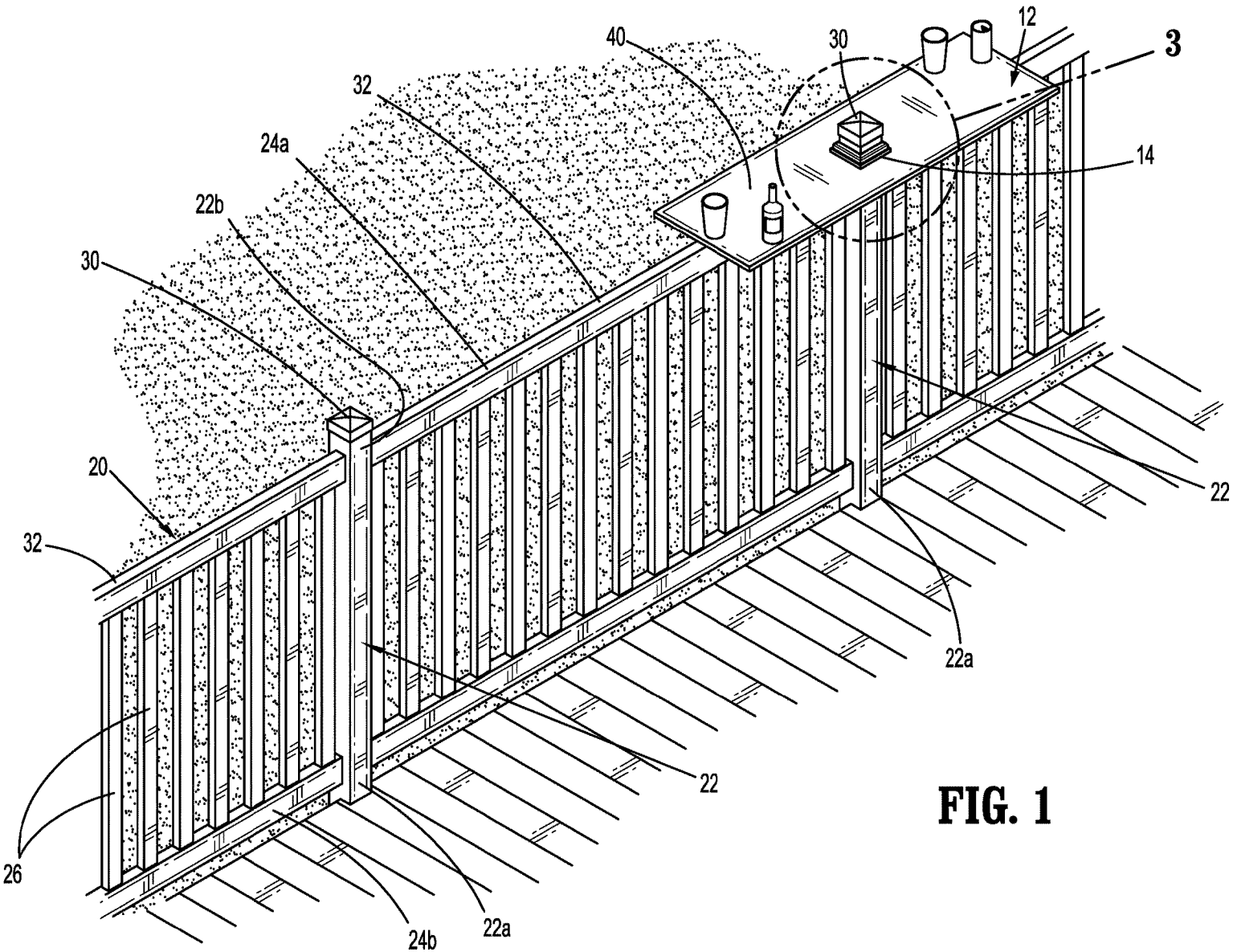
FIG. 1 is a side perspective view of an existing fence with an exemplary embodiment of the disclosed fence rail system including a center mounted rectangular table top supported on the fence.

Exemplary embodiments of the disclosed table top fence rail system will now be described in detail with reference to the drawings in which like reference numerals designate identical or corresponding elements in each of the several views. However, it is to be understood that the disclosed embodiments are merely exemplary of the disclosure and may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. In addition, directional terms such as front, rear, upper, lower, top, bottom, distal, proximal, and similar terms are used to assist in understanding the description and are not intended to limit the present disclosure.

Figure 2:
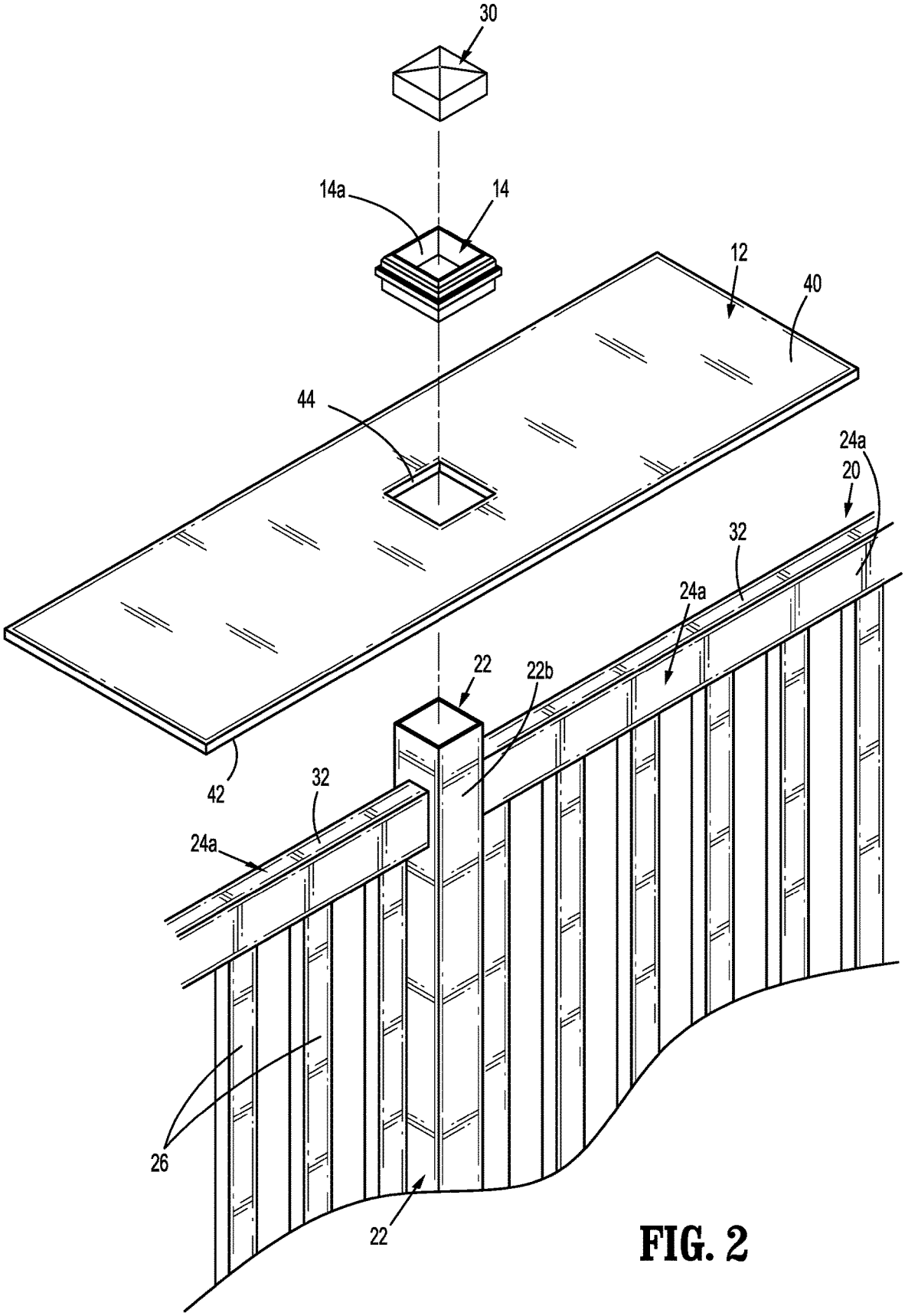
FIG. 2 is a side perspective view of the fence and fence rail system with parts separated.
Figure 3:
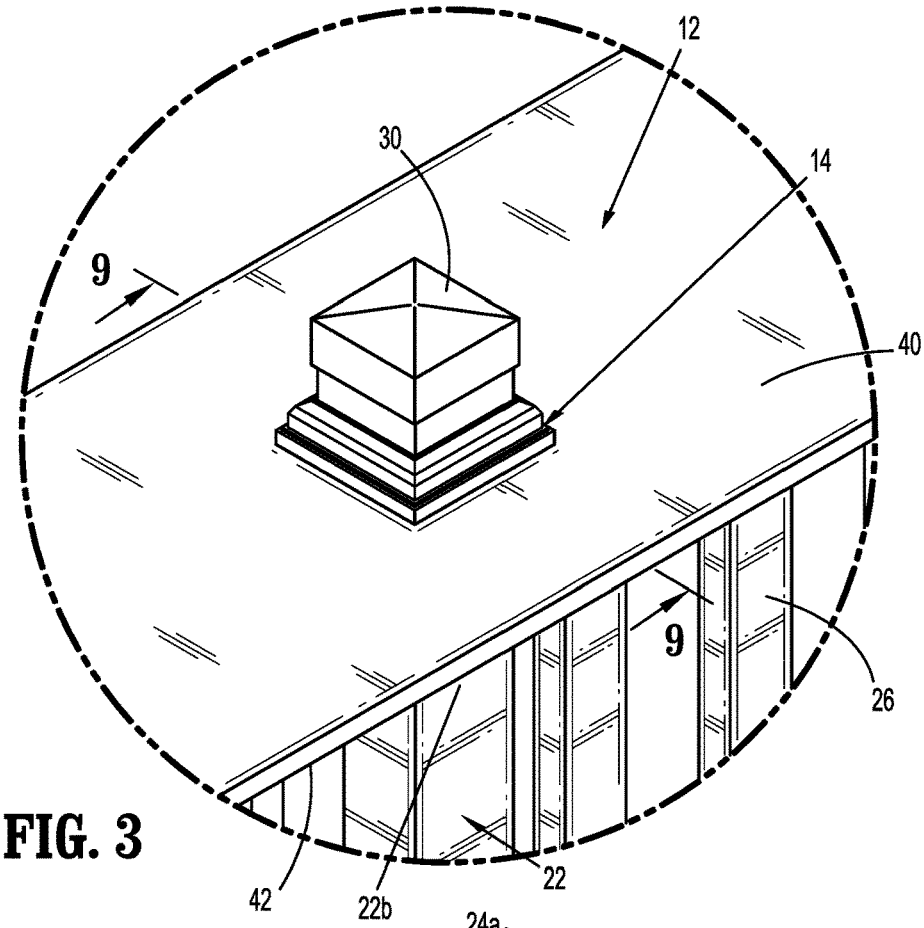
FIG. 3 is an enlarged view of the indicated area of detail shown in FIG. 1.

FIGS. 1-3 illustrate an exemplary embodiment of the disclosed fence rail system shown generally as 10. The fence rail system 10 includes a table top 12 and a sleeve 14 that are mounted onto a new or existing fence 20. The fence 20 includes spaced posts 22, upper and lower horizontal rails 24*a*, 24*b*, and a plurality of slats 26. The slats 26, although illustrated as being vertical, can be mounted in any desirable orientation. The posts 22 have a lower end 22*a* supported in the ground or in another support surface and an upper end 22*b* that supports a cap 30. The upper and lower horizontal rails 24*a*, 24*b* extend between the posts 22. In embodiments, the upper horizontal rail 24*b* includes a flat upper support surface 32 although other configurations are envisioned. The vertical slats 26 are supported between the upper and lower horizontal rails 24*a*, 24*b* and provide stability to the fence 20.

The table top 12 includes planar upper and lower surfaces 40, 42 respectively. The upper surface 40 of the table top 12 is configured to support objects such as plates, glasses, speakers, or the like. The lower surface 42 of the table top 12 is configured to rest atop the flat upper support surface 32 of the upper horizontal rail 24*a* to stabilize the table top on the fence 20. The table top 12 defines a central opening 44 (FIG. 2) that is dimensioned to receive the upper end 22*b* of the post 22.

The sleeve 14 includes an inner bore 14*a* that is dimensioned to receive the upper end 22*b* of the post 22. The inner bore 14*a* should be dimensioned to snugly receive the upper end 22*b* of the post 22 so that the sleeve 14 frictionally engage the outer surface of the post 22 to a degree to be retained in a fixed vertical position on the post 22. When the sleeve 14 is pressed downwardly onto the post 22 into engagement with the planar upper surface 40 of the table top 12, the sleeve 14 will provide a force on the upper planar surface 40 of the table top 12 to hold the table top 12 against the flat upper surface 32 of the upper horizontal rail 24*a* and provide stability to the table top 12.

In use of the fence rail system 10, the cap 30 is removed from the upper end 22*b* of the post 22 and the table top 12 is placed on the flat upper surface 32 of the upper horizontal rail 24*a* such that the upper end 22*b* of the post 22 is received through the opening 44 in the table top 12. Although only a single opening 44 is shown in the table top 12 in FIG. 2, it is envisioned that a table top 12 that has a length greater than the distance between two adjacent posts 22 may include two openings 44 to receive the two adjacent posts 22.

After the table top 12 is supported on the flat upper surface 32 of the upper rail 24*a*, the sleeve 14 can be positioned on the upper end 22*b* of the post 22 to press the table top 12 against the upper rail 24*a*. This will provide stability to the table top 12 on the flat surface 32 of the upper rail 24*a*. In embodiments, the sleeve 14 may have a decorative configuration to make the table top fence rail system 10 more aesthetically pleasing. The cap 30 can be replaced on the upper end 22*b* of the post 22 to secure the sleeve 14 on the post 22 against the upper planar surface 40 of the table top 12. In embodiments, the sleeve 14 and/or the cap 30 can be fixedly secured to the upper end 22*b* of the post 22 to provide more stability to the table top 12. For example, the sleeve 14 and/or the cap 30 may be glued or bolted to the upper end 22*b* of the post 22.

Figure 4:
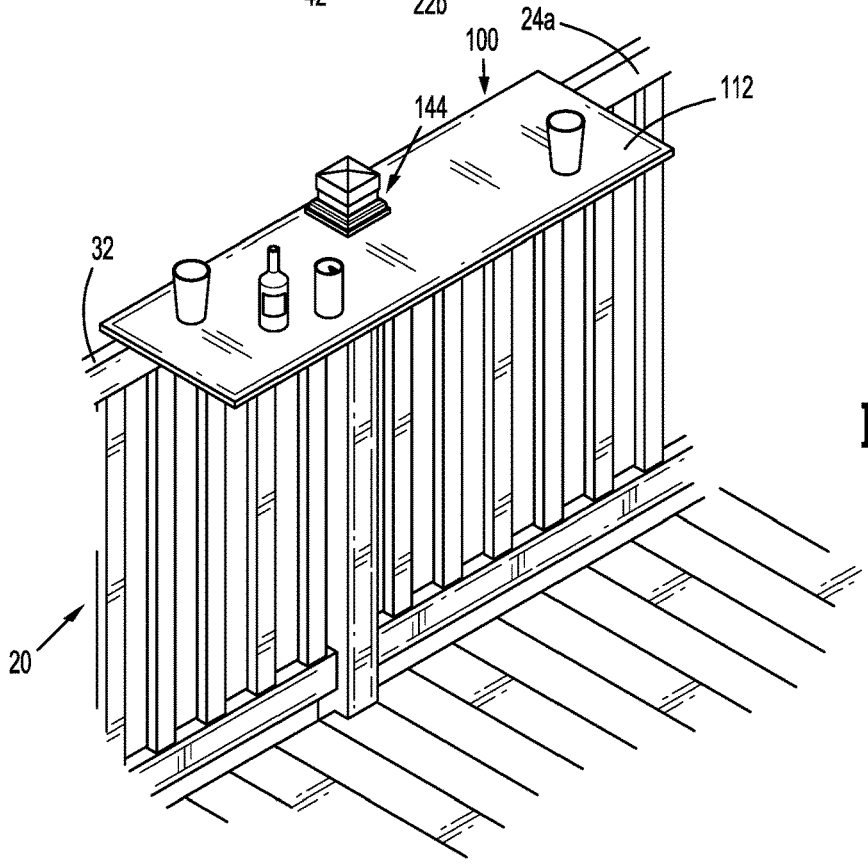
FIG. 4 is a side perspective view of another embodiment of the disclosed fence rail system including a side mounted rectangular table top supported on a fence.

FIG. 4 illustrates another exemplary embodiment of the disclosed fence rail system shown generally as fence rail system 100. The fence rail system 100 is substantially identical to the fence rail system 10 except that the opening 144 formed in the table top 112 is positioned on one side of the table top 112 rather than at a central location within the table top 112. In this system, one side of the table top 12 is supported on the flat upper surface 32 of the upper rail 24*a* of the fence 20. This provides for a table top 112 that extends to one side of the fence 20 rather than to both sides of the fence 20.

Figure 5:
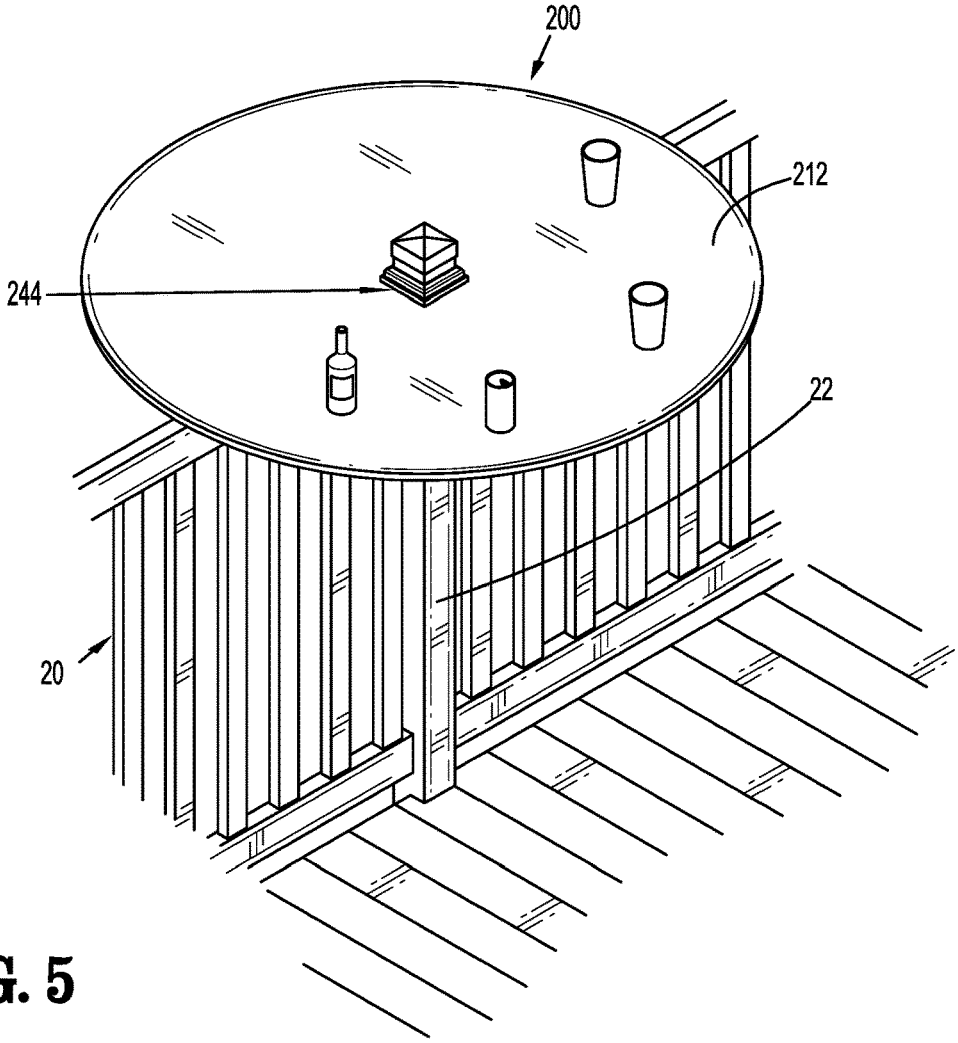
FIG. 5 is a side perspective view of another embodiment of the disclosed fence rail system with a center mounted circular table top supported on the fence.
Figure 6:
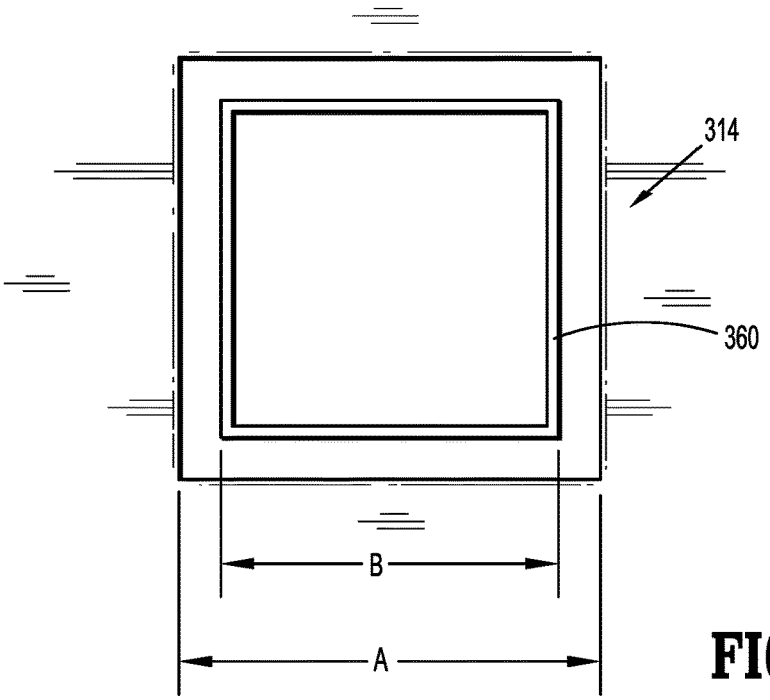
FIG. 6 is a top view of an adapter of the fence rail system shown in FIG. 1.
Figure 7:
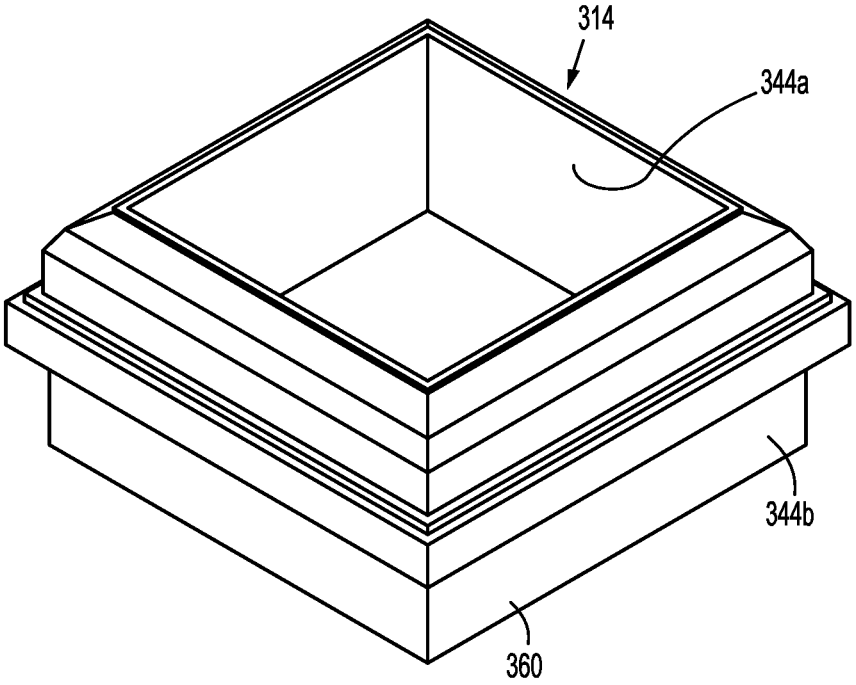
FIG. 7 is a side perspective view of the adapter shown in FIG. 6.
Figure 8:
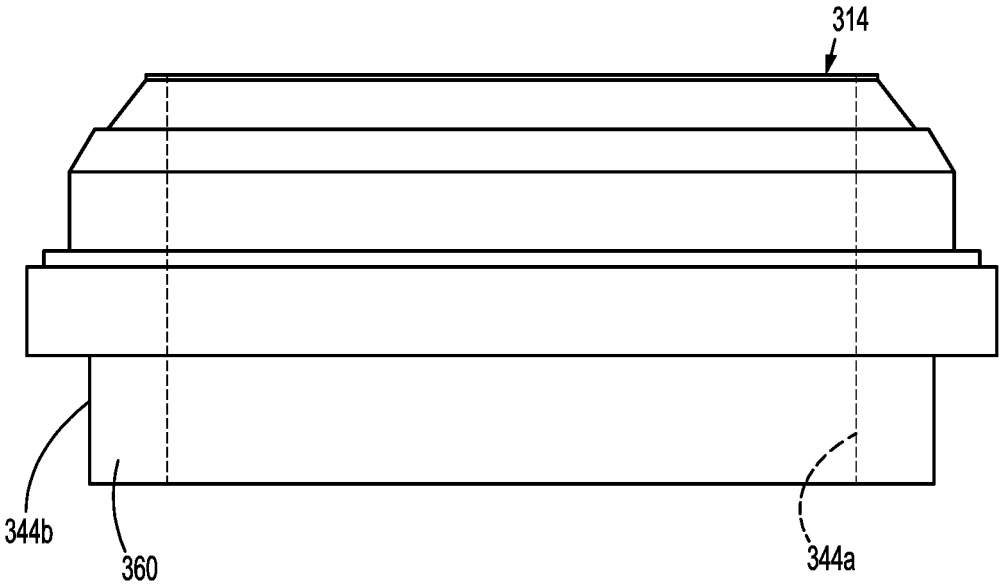
FIG. 8 is a side view of the adapter shown in FIG. 6.
Figure 9:
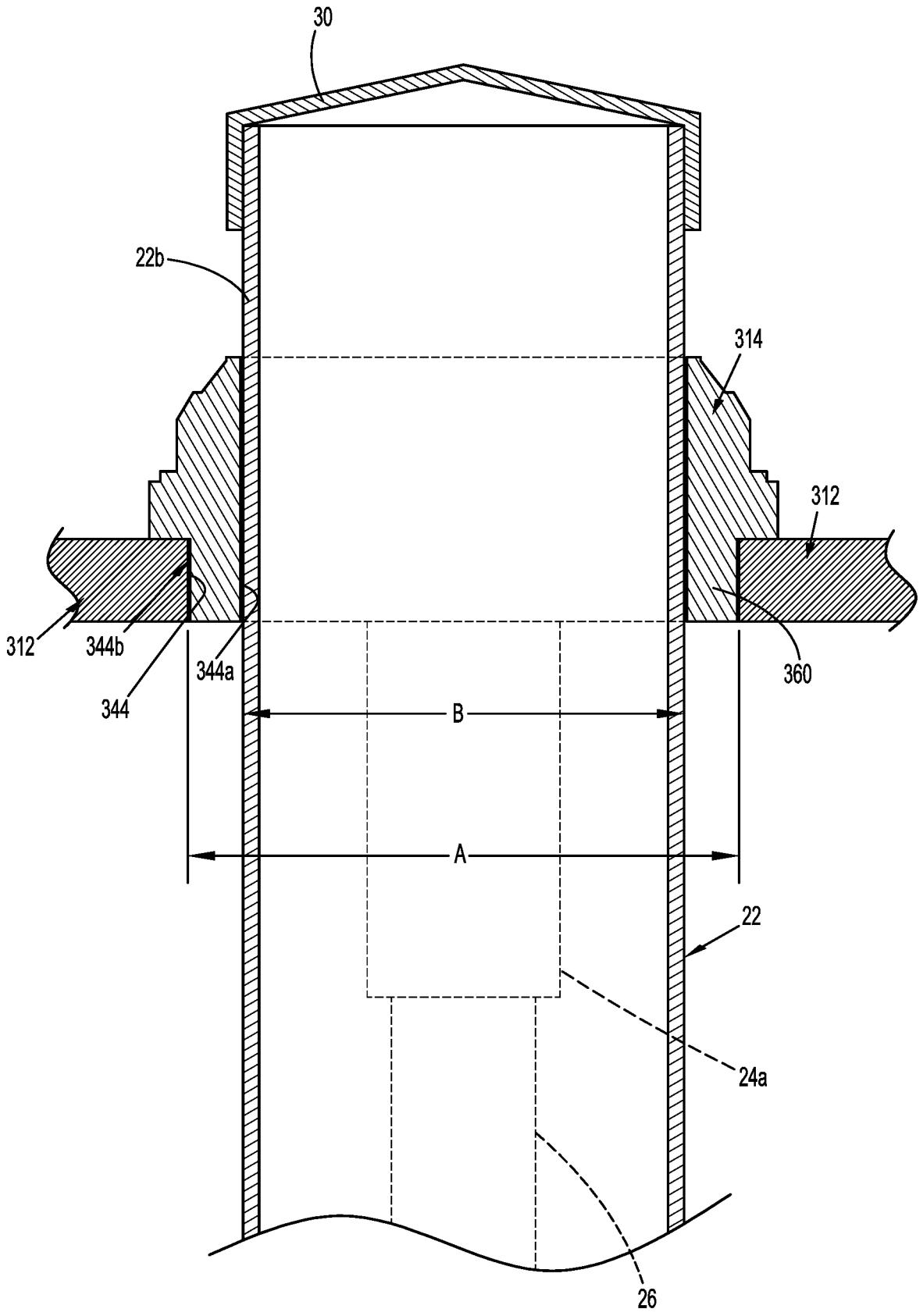
FIG. 9 is a side cross-sectional view of the adapter and table top shown in FIG. 1 supported on the fence.

FIG. 5 illustrates another exemplary embodiment of the disclosed fence rail system shown generally as fence rail system 200. The fence rail system 200 is substantially identical to the fence rail system 10 shown in FIG. 1 except that the table top 212 is circular rather than rectangular. In this embodiment, the table top 212 defines an opening 244 in a central portion of the table top 212 that is dimensioned to receive the post 22 of the fence 20. Although only rectangular and circular table tops 12, 112, and 212 are illustrated in this application, it is envisioned that the table top may assume any desired configuration in accordance with this disclosure.

FIGS. 6-9 illustrate an alternative embodiment of the sleeve 314 of the fence rail system which functions as an adapter. In some embodiments, the hole 344 (FIG. 9) in the table top 312 may be sized to receive a post 22 of a fence 20 that has a first width "A" (FIG. 6), e.g., a 5 inch width, but the post 22 may have a second smaller width "B" (FIG. 6), e.g., a 4 inch width. It is noted that standard size posts in vinyl fencing have 4 and 5 inch widths. Where the width of the hole 344 (FIG. 9) in the table top 312 is larger than the width of the post 22, the sleeve 314 may include a lower extension 360 that has an opening 344*a* that is dimensioned to receive the smaller post 22 and an outer surface 344*b* that is dimensioned to be snugly received within the opening 344 of the table top 312 in a friction fit manner. When the sleeve 314 is positioned about the upper end 22*b* of the post 22, the lower extension 360 is positioned between the post 22 and the table top 312 such that the table top 312 is stabilized on the post 22. This allows table tops 312 to be used with fence posts 22 of different sizes.

Figure 10:
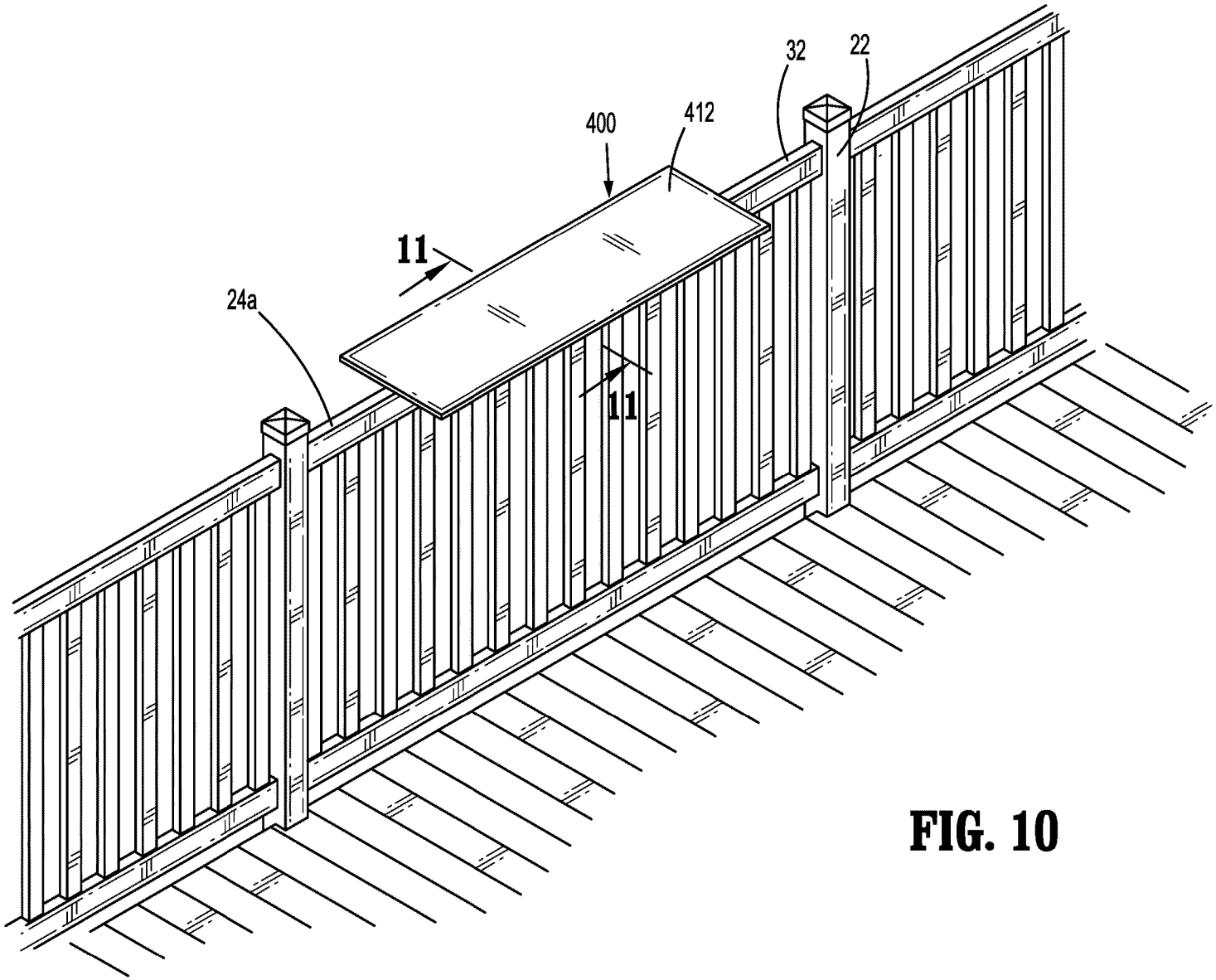
FIG. 10 is a side perspective view of another exemplary embodiment of the disclosed fence rail system including a rectangular table top supported on the fence.
Figure 11:
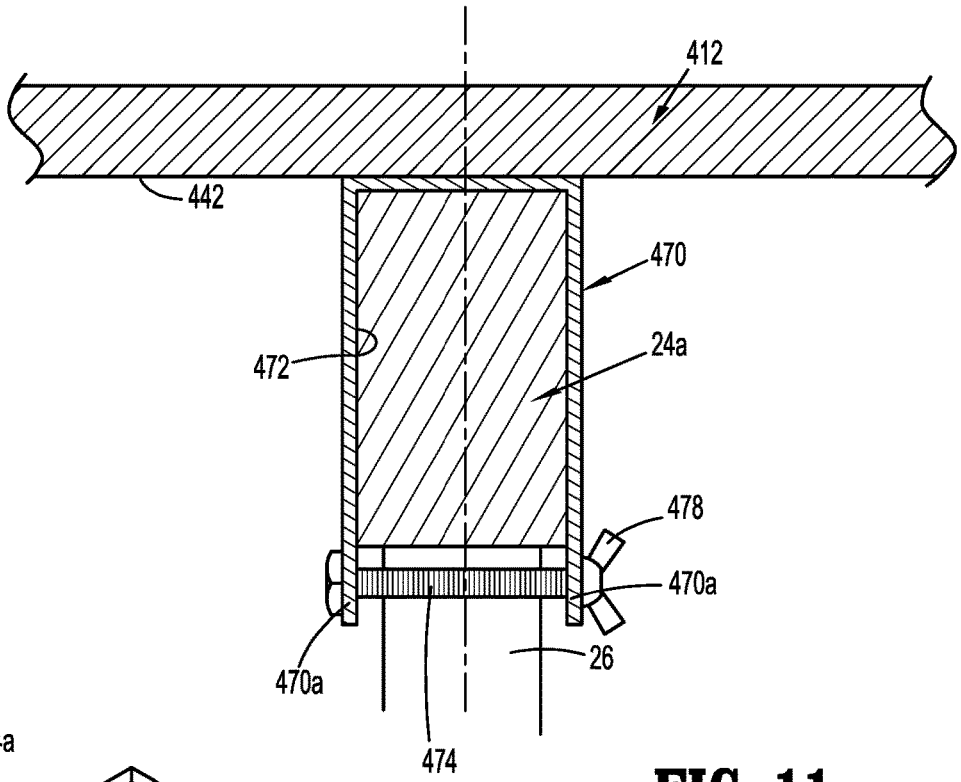
FIG. 11 is a cross-sectional view taken along section line 11-11 of FIG. 10.
Figure 12:
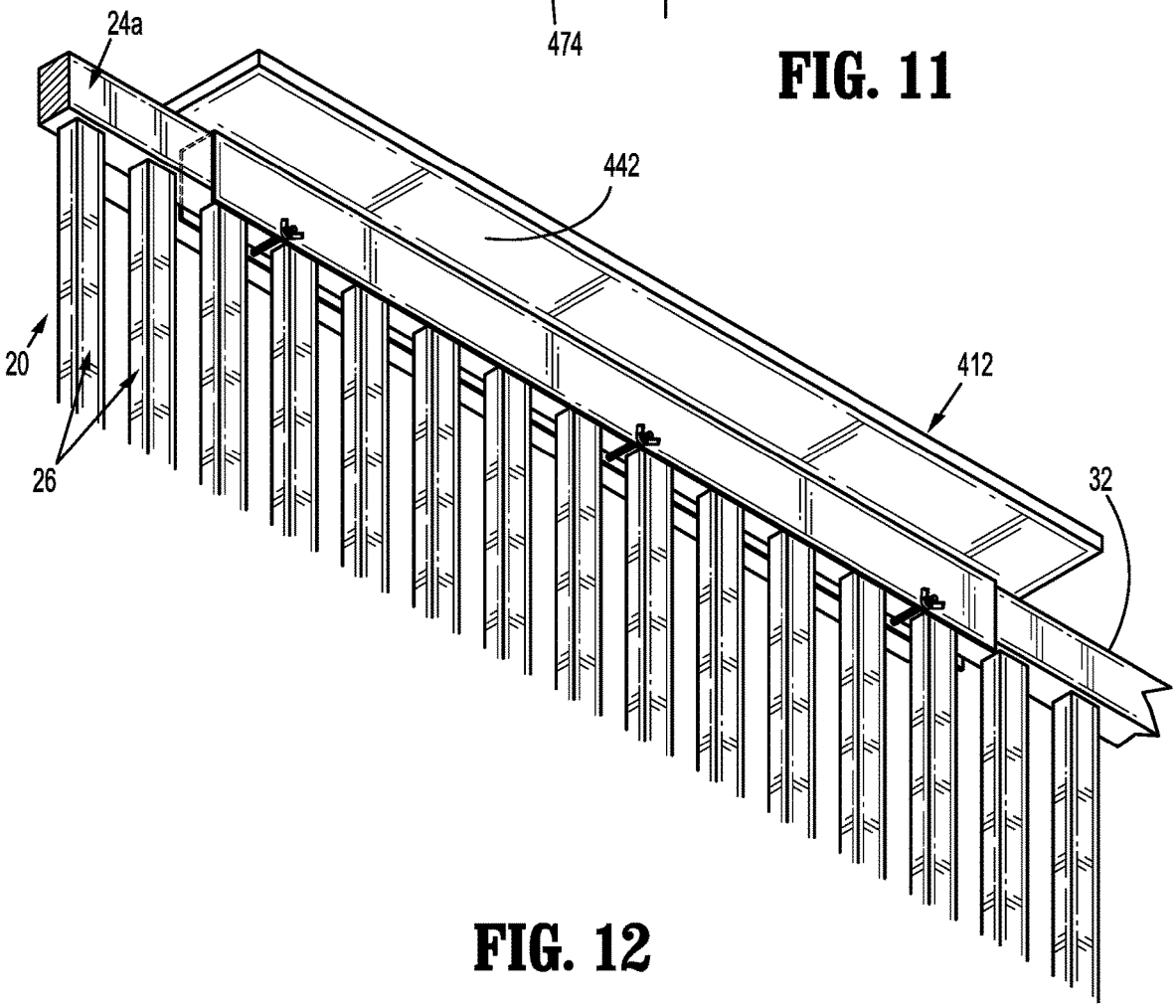
FIG. 12 is a view from the bottom of the fence rail system shown in FIG. 10.

FIGS. 10 and 11 illustrate an alternate embodiment of the disclosed fence rail system shown generally as 400. The fence rail system 400 differs from the fence rail systems disclosed above in that the table top 412 does not have an opening to receive a fence post 22. In contrast, the fence rail system 400 includes a lower bracket 470 that defines a U-shaped channel 472 and extends downwardly from a bottom surface 442 of the table top 412. The channel 472 has a depth to receive the upper rail 24*a* of the fence 20 such that ends 470*a* of the lower bracket 470 extend below the upper rail 24*a*. The bracket 470 supports a securing mechanism such as bolts 474 that extend between the ends of the bracket 470 at a location beneath the upper rail 24*a* of the fence 20. When the table top 412 is positioned on the flat upper surface 32 of the upper rail 24*a*, the bolts 474 extend below the upper rail 24*a* to secure the table top 412 to the upper rail 24*a* of the fence 20.

Figure 13:
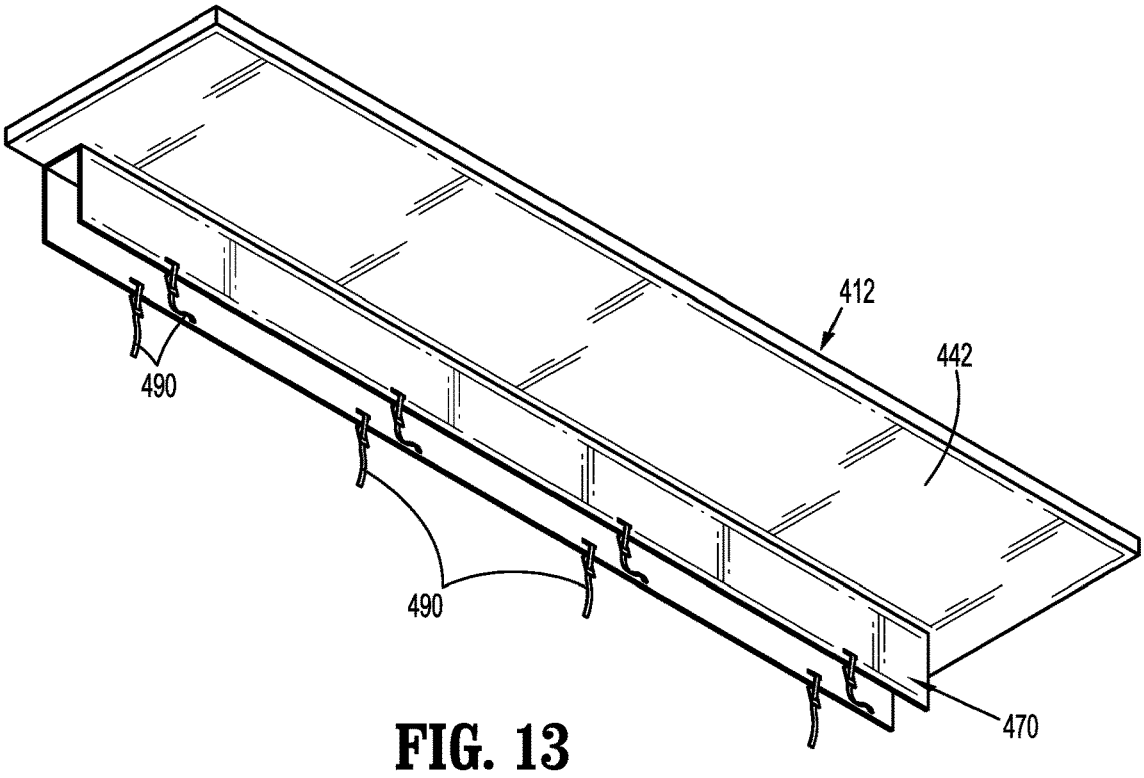
FIG. 13 is a bottom perspective view of another exemplary embodiment of the disclosed fence rail system including a rectangular table top supported on the fence.

In embodiments, the bracket 470 can be secured to the bottom surface of the table top 412 using any known fastening technique including screws, bolts, welding or the like. The bolts 474 can be secured between opposite sides of the lower bracket 470 using threaded wing nuts 478 (FIG. 11). Alternately other securement mechanisms or techniques can be used to secure the bracket 470 to the upper rail 24*b* of the fence 20. For example, as shown in FIG. 13, straps 490 having hooked and loop fasteners can be used to secure the bracket 470 to the upper rail 24*a* of the fence 20.

Figure 14:
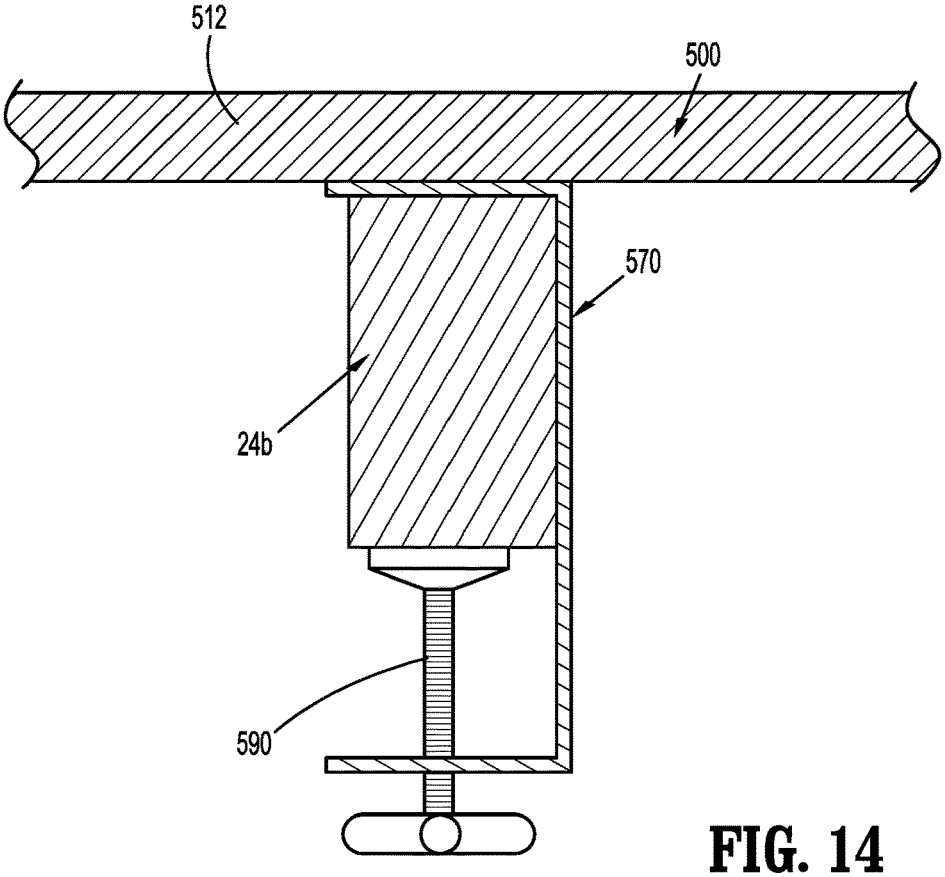
FIG. 14 is a cross-sectional view of another exemplary embodiment of the disclosed fence rail system including a table top supported on the fence.

FIG. 14 illustrates another exemplary embodiment of the disclosed fence rail system shown generally as fence rail system 500. The fence rail system 500 is substantially identical to the fence rail system 400 except that the bracket 570 is C-shaped and includes a threaded clamp 590 to secure the bracket 570 to the upper rail 24*b* of the fence 20. It is envisioned that the brackets 470 and 570 may be used with the table tops including a central opening that receives a post 22 of the fence 20 to provide greater stability to the table tops after the table tops are secured to the fence 20.

It is envisioned that the table tops, sleeves, and/or brackets can be provided as part of a kit to facilitate attachment of a table top to an existing fence such as a vinyl fence. However, it is envisioned that the present system can be used with a variety of fence types. The presently disclosed kit would include at least one table top 12, 112, 212, 312, 412 and/or 512, one or more sleeves 14, 314, and additional caps 30. During installation of the table tops 12, 112, 212 onto an existing or new fence 20, the cap 30 can be removed from the upper end portion 22*b* of a post 22 fence 20 and one of the table tops can be positioned about the upper end of the post 22*b* and secured in place as described above. The table tops 412 and 512 can also be secured to a fence 20 in the manner described above.

Persons skilled in the art will understand that the devices and methods specifically described herein and illustrated in the accompanying drawings are non-limiting exemplary embodiments. For example, although the slats are shown to run vertically between the upper and lower rails, it is envisioned that the slats may run horizontally between the posts. It is also envisioned that the horizontal slats me be similar in configuration to the upper and lower rails. It is envisioned that the elements and features illustrated or described in connection with one exemplary embodiment may be combined with the elements and features of another without departing from the scope of the present disclosure. As well, one skilled in the art will appreciate further features and advantages of the disclosure based on the above-described embodiments. Accordingly, the disclosure is not to be limited by what has been particularly shown and described, except as indicated by the appended claims.

What is claimed is:

1. A table top fence rail system comprising:

a fence including first and second posts, an upper horizontal rail extending between the first and second posts, a lower horizontal rail extending between the first and second posts, and a plurality of slats positioned between the posts, the upper horizontal rail defining an upper support surface, and the first and second posts having an upper end portion and a lower end portion;

a table top including a one piece body having planar top and bottom surfaces, the body defining an opening that extends between the planar top and bottom surfaces of the body of the table top, the opening receiving the upper end portion of a respective one of the first and second posts, wherein the table top slides about the respective first or second post and is supported on the upper horizontal rail with the planar bottom surface of the table top engaged with the upper horizontal rail; and a cap supported on the upper end portion of the respective one of the first and second posts, the cap being dimensioned to engage the planar top surface of the one piece body of the table top to retain the planar bottom surface of the one piece body of the table top on the upper support surface of the upper horizontal rail of the fence.

2. The table top fence rail system of claim 1, wherein the opening defined by the body of the table top and the respective one of the first and second posts are rectangular.

3. The table top fence rail system of claim 1, wherein the opening defined by the body of the table top is centrally positioned within the body of the table top.

4. The table top fence rail system of claim 1, wherein the opening defined by the body of the table top is positioned along one side of the body of the table top.

5. The table top fence rail system of claim 1, wherein the body of the table top has a rectangular configuration.

6. The table top fence rail system of claim 1, wherein the body of the table top has a circular configuration.

7. The table top fence rail system of claim 1, wherein the slats extend vertically between the upper and lower horizontal rails of the fence.

8. A table top fence rail system comprising:

a fence including first and second posts, an upper horizontal rail extending between the first and second posts, a lower horizontal rail extending between the first and second posts, and a plurality of slats positioned between the posts, the upper horizontal rail defining an upper support surface, and the first and second posts having an upper end portion and a lower end portion;

a table top including a body having planar top and bottom surfaces, the body defining an opening that extends between the planar top and bottom surfaces of the body of the table top, the opening being dimensioned to receive the upper end portion of a respective one of the first and second posts;

a cap supported on the upper end portion of the respective one of the first and second posts, the cap being dimensioned to retain the planar bottom surface of the body of the table top on the upper support surface of the upper horizontal rail of the fence; and a sleeve positioned about the upper end portion of the respective one of the posts between the planar top surface of the body of the table top and the cap.

9. The table top fence rail system of claim 8, wherein at least one of the sleeve and the cap are secured to the upper end portion of the respective one of the posts.

10. The table top fence rail system of claim 8, wherein the opening defined by the body of the table top is larger than the respective one of the posts, and the sleeve includes a lower extension that is received between the upper end portion of the respective one of the posts and the body of the table top to snugly position the table top on the upper end portion of the respective one of the posts.

11. A table top fence rail system comprising:

a table top including a body having planar top and bottom surfaces, the body defining an opening that extends between the planar top and bottom surfaces of the body of the table top, first and second fence posts, an upper horizontal rail extending between the first and second posts, a lower horizontal rail extending between the first and second posts, and a plurality of slats positioned between the posts, the opening being dimensioned to receive an upper end of one of the first and second posts;

a sleeve defining a through bore dimensioned to snugly receive the upper end of the fence post, the through bore dimensioned to secure the sleeve to the fence post to retain the table top on the fence post; and a cap defining an inner bore dimensioned to receive the upper end of the fence post, the sleeve positioned about the upper end portion of the respective one of the posts between the planar top surface of the body of the table top and the cap.

12. The table top fence rail system of claim 11, wherein the opening defined by the body of the table top and the respective one of the first and second posts are rectangular.

13. The table top fence rail system of claim 11, wherein the opening defined by the body of the table top is centrally positioned within the body of the table top.

14. The table top fence rail system of claim 11, wherein the opening defined by the body of the table top is positioned along one side of the body of the table top.

15. The table top fence rail system of claim 11, wherein the body of the table top has a rectangular configuration.

16. The table top fence rail system of claim 11, wherein the body of the table top has a circular configuration.

17. The table top fence rail system of claim 11, wherein the sleeve includes a lower extension that is received between the upper end portion of the fence post and the body of the table top to snugly position the table top on the upper end portion of the fence post.

* * * * *